US005685114A

United States Patent [19]

Tanaka

[11] Patent Number: 5,685,114

[45] Date of Patent: Nov. 11, 1997

[54] STRUCTURAL MEMBER, FLOOR STRUCTURE, AND ROOF STRUCTURE FOR WOODEN BUILDING AND A METHOD OF BUILDING WITH THE SAME

[75] Inventor: Masakatsu Tanaka, Osaka, Japan

[73] Assignee: Tanaka Masakatsu Design Office Co., Ltd., Osaka, Japan

[21] Appl. No.: 618,114

[22] Filed: Mar. 19, 1996

[30] Foreign Application Priority Data

Mar. 20, 1995 [JP] Japan ..... 7-087323

[51] Int. Cl.[6] ..... E04B 1/08

[52] U.S. Cl. ..... 52/271; 52/267; 52/284; 52/299; 52/92.1

[58] Field of Search ..... 52/267, 271, 284, 52/92.1, 737.3, 790.1, 299, 297, 344; 403/382, 326, 345–347

[56] References Cited

U.S. PATENT DOCUMENTS

| | | | |
|---|---|---|---|
| 424,798 | 4/1890 | Lazell | 52/737.3 |
| 2,099,149 | 11/1937 | Turnquist | 52/271 |
| 2,129,441 | 9/1938 | Otto | 52/271 |
| 3,179,983 | 4/1965 | Webber et al. | 52/737.3 X |
| 3,452,498 | 7/1969 | Kinsey | 52/284 X |
| 3,531,901 | 10/1970 | Will, Jr. et al. | 52/737.3 X |
| 3,774,362 | 11/1973 | Matuschek et al. | 52/92.1 X |
| 3,968,989 | 7/1976 | Schippers | 52/271 X |
| 4,745,722 | 5/1988 | Ross | 52/284 X |
| 4,879,850 | 11/1989 | Glassco et al. | 52/284 |
| 5,207,042 | 5/1993 | Molinar | 52/92.1 X |
| 5,325,649 | 7/1994 | Kojiwara | 52/271 X |
| 5,351,453 | 10/1994 | Leslie | 52/284 X |

FOREIGN PATENT DOCUMENTS

| | | |
|---|---|---|
| 62-258031 | 11/1987 | Japan . |
| 63-144204 | 9/1988 | Japan . |
| 6-182720 | 7/1994 | Japan . |

*Primary Examiner*—Wynn E. Wood
*Assistant Examiner*—W. Glenn Edwards
*Attorney, Agent, or Firm*—Jordan and Hamburg

[57] ABSTRACT

A structural member, a floor structure, and a roof structure for a wooden building, and a method of building with the same are provided. The method comprises mounting floor panels on a foundation, mounting on sills wall panels provided with L shaped pillars of a plywood laminated material to produce a wall structure of the first floor, mounting and joining second-floor panels by panel support assemblies to the first-floor wall structure, and joining the second-floor panels with their beams connecting to each other to produce a floor structure of the second floor. This is followed by assembling a wall structure of the second floor, joining roof panels to each other by retainer assemblies on a ridge beam, and joining the roof panels with arms connecting to each other to produce a roof structure. Accordingly, the steps of making the floor, wall, and roof structures are minimized in number.

8 Claims, 12 Drawing Sheets

FIG. 5

| STRENGTH OF COMMON LUMBER (MATERIALS : NEEDLE-LEAF TREES SUCH AS CYPRESS AND PINE) | | | STRENGTH OF PLYWOOD LAMINATED MATERIAL USED IN STRUCTURAL ASSEMBLY OF THE INVENTION (MATERIALS : BROAD-LEAF TREES SUCH AS LAUAN AND BEECH) | | |
|---|---|---|---|---|---|
| RESISTANCE TO LONG-TERM LOAD kg/cm² | | | RESISTANCE TO LONG-TERM LOAD kg/cm² | | |
| COMPRESSION | TENSION/ BENDING | SHEAR | COMPRESSION | TENSION/ BENDING | SHEAR |
| 80 | 90 | 7 | 225 | 225 | 15 |

STRUCTURAL MEMBER, FLOOR STRUCTURE, AND ROOF STRUCTURE FOR WOODEN BUILDING AND A METHOD OF BUILDING WITH THE SAME

BACKGROUND OF THE INVENTION

1. Field of the Invention

The present invention relates to a structural member, a floor structure and a roof structure for a wooden building, and to a method of building with the same.

2. Description of the Related Art

There are known a variety of conventional framing methods for building wooden structures and housings. The conventional methods are however employ a great number of structural components and requires specific skills for making connections and joints thus increasing the period of construction time and the overall cost. For improvement of the above methods, a two-by-four (hereinafter referred to as 2×4) method is also used in which floor panels and bearing walls are assembled in a unit of building. This method allows the panels and walls to be joined to each other with nails and metal members thus facilitating the joint and connection works. Its erection work is rationally designed with the use of floor frameworks. Accordingly, the 2×4 method is higher in efficiency and reduced in the construction period as compared with the other conventional framing methods.

PROBLEM TO BE SOLVED BY THE INVENTION

The 2×4 method still requires installation of a considerable number of floor framework members including beams and braces. For the roof framing, installation of a large number of structural members such as rafters, struts, and purlins is essential and involves multiple steps. The wall construction is carried out depending on the conditions at site and consumes another steps. The floor, wall, and roof frameworks are made of various types of lumber and laminated timber which are costly. As the result, the 2×4 method is also not low in the cost of both materials and construction work.

SUMMARY OF THE INVENTION

It is an object of the present invention, for solving the foregoing problems, to provide a method of making wooden buildings in which the steps of installing the floor frameworks, wall frameworks, and roof section are decreased in number, the cost of structural materials is low, and the resistance to earthquake is increased.

According to a structural member for a wooden building of the present invention, two plywood laminated materials, each material comprising a plurality of sheet plywood boards bonded one over the other, are joined to each other so that their laminating directions are perpendicular to each other, thus increasing the strength to compression and shear. Also, the structural member when installed as a pillar on a sill(s) has a large two-dimensional contact area with the sill(s) and will be stable in the joining to the sill(s) and increased in the resistance to earth-quake of the building. Also, a joint supplement is embedded at a right angle to and in a substantially center region of the interface between the two plywood laminated materials for joining together with the plywood laminated materials. This increases the bonding strength between the two plywood laminated materials thus preventing adverse peeling off or separation. As the structural member is made of the plywood boards, its cost will be lower than that of lumber and laminated timber.

According to another structural member of the present invention, two plywood laminated materials are joined to each other by fitting an edge of one material to a recess provided in a side surface of the other so that their laminating directions are perpendicular to each other, thus increasing the strength to compression and shear. Also, the structural member when installed as a pillar on a sill(s) has a large two-dimensional contact area with the sill(s) and will be stable in the joining to the sill(s) and increased in the resistance to earth-quake of the building. Also, one of the two plywood laminated materials is fitted into the recess provided in the other to produce a tighter interface. This increases the bonding strength between the two plywood laminated materials thus preventing adverse peeling off or separation. As the structural member is made of the plywood boards, its cost will be lower than that of lumber and laminated timber.

According to the present invention, a reinforcement is embedded at a right angle to and in a substantially center region of the interface between the above two plywood laminated materials for joining together with the plywood laminated materials. This increases the bonding strength between the two plywood laminated materials thus preventing adverse peeling off or separation.

According to the present invention, the above plywood laminated material has a reinforcement of a steel material embedded lengthwisely therein thus increasing the strength to compression and shear.

According to a floor structure of the present invention, floor panels are anchored by panel support assemblies to walls and joined to each other with their beams tightening to each other, thus eliminating the installation of traditional floor structural components such as joists and braces. The construction of the floor structure will hence be simple and its steps will be decreased in number. As each floor panel which comprises two, upper and lower, plywood boards, is supported with its beams joining by bolts to the panel support assemblies as well as another panel support assembly. This allows the floor structure to be higher in the physical strength than any conventional floor framework where floor sheets are held by joists.

According to a roof structure of the present invention, roof panels are anchored by joiner assemblies to walls and joined to each other with their beams tightening to each other as well as retainer assemblies mounted on a ridge beam, thus eliminating the installation of traditional roof structural components such as rafters, struts, and purlins. The construction of the roof structure will hence be simple and its steps will be decreased in number. As each roof panel which comprises two, upper and lower, plywood boards, is supported with its beams joining by bolts to the joiner and retainer assemblies. This allows the roof structure to be higher in the physical strength than any conventional roof framework consisting of rafters, struts, and purlins.

According to a method of constructing a wooden building of the present invention, a floor structure is built with floor panels mounted to panel support assemblies on the foundation, a wall structure is built with wall panels, and a roof structure is built with roof panels mounted by retainer and joiner assemblies to a ridge beam and the wall structure, thus eliminating the installation of traditional floor structural components such as joists and braces at the step of making the floor structure and roof structural components such as rafters, struts, and purlins at the step of making the roof structure. The overall steps will hence be minimized while each step being facilitated. Also, the floor and roof structures will be higher in the physical strength than traditional floor and roof frameworks.

According to another method of constructing a wooden building of the present invention, a floor structure of the second floor is built with second-floor panels mounted by panel support assemblies to a wall structure, thus eliminating the installation of traditional floor structural components such as joists and braces. This allows the second-floor structure to be easier in the construction and higher in the physical strength than any conventional second floor framework.

BRIEF DESCRIPTION OF THE DRAWINGS

FIG. 5 is a diagram showing comparison in the strength between the plywood laminated material used as a pillar in the method of the present invention and common lumber material;

DETAILED DESCRIPTION OF THE EMBODIMENTS

Figure 1:
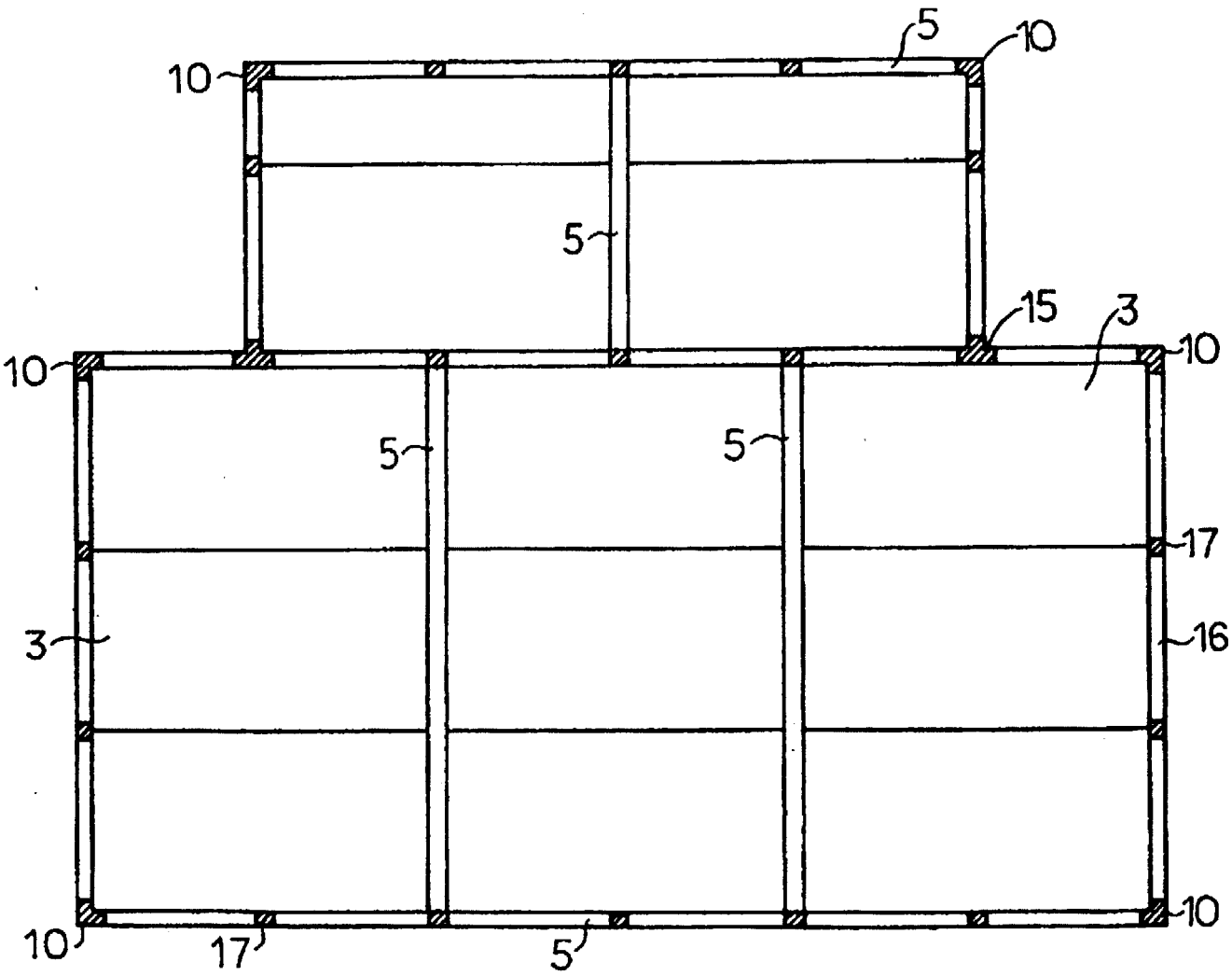
FIG. 1 is a plan view showing an arrangement of pillars, intermediate pillars, and sills and an allocation of floor panel in a building constructed by a method according to the present invention.
Figure 2:
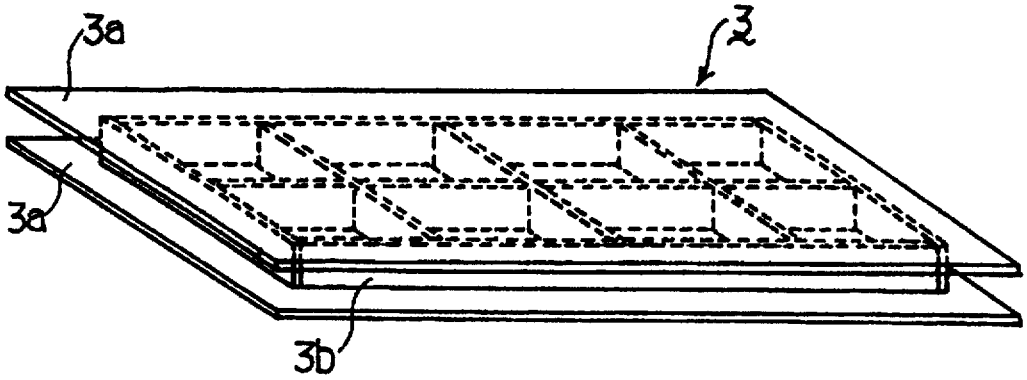
FIG. 2 is a perspective view showing a fundamental form of the floor panel used in the method of the present invention.
Figure 3:
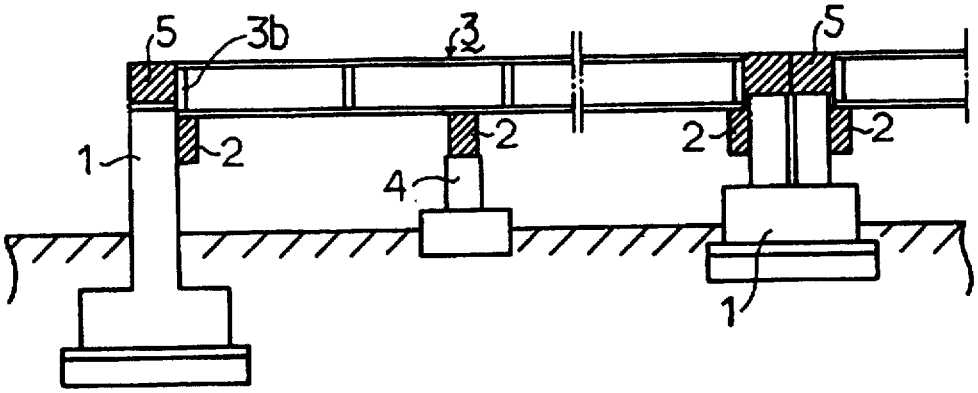
FIG. 3 is a side view showing installation of the floor panels on the sills and foundation.

Embodiments of the present invention will be described referring to the accompanying drawings. FIG. 1 is a plan view showing an arrangement of pillars, intermediate pillars, and sills and an allocation of floor panels in a building constructed by a method of the present invention. FIG. 2 is a perspective view showing a fundamental shape of the floor panel used in the method of the present invention. FIG. 3 is a side view of the floor panels being installed on the foundation and sills. The foundation 1 is preferably a steel-reinforced concrete base for ensuring optimum structural strength. The floor panels 3 forming a floor framework are supported by panel supports 2 mounted inside the building. The panel supports 2 may be arranged integral with the foundation 1 or installed later at the site.

The floor panel 3 has a construction in which a plurality of cross members 3*b* are framed between two surface boards 3*a* (FIG. 2). The surface boards 3*a* and cross members 3*b* are made of plywood. The number of the cross members 3*b* and the thickness and size of the surface boards 3*a* and cross members 3*b* are varied depending on the requirement of strength. The floor panels 3 are mounted on the panel supports 2 forming the floor framework. The floor framework is increased in the strength by locating the cross members 3*b* at the joints between the floor panels 3 and the panel supports 2 (FIG. 3). As the floor panels 3 are laid throughout a floor space (FIG. 1), the floor framework is completed with the panel supports 2 joined to the floor panels 3. Also, each the floor panel 3 is sustained at center by a combination of the panel support 2 and a post 4. The sills 5 are mounted flush with the floor panels 3. In particular, the floor panels 3 are utilized as components of the wall framework and roof section with their surface boards 3*a* and cross members 3*b* being trimmed to appropriate sizes for applications.

Figure 4:
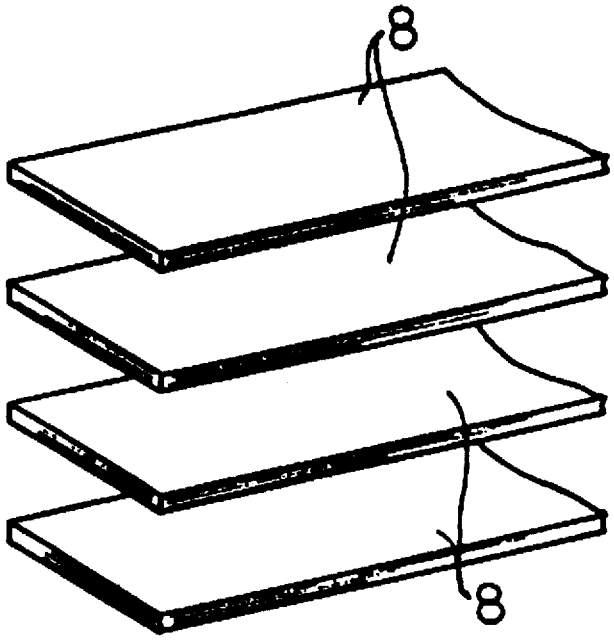
FIGS. 4(*a*) and 4(*b*) are a perspective exploded view and a perspective view of a plywood laminated material respectively.
Figure 4:
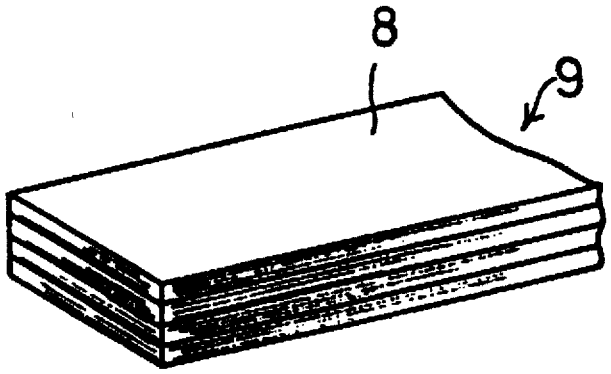

A plywood laminated material which is a member of a structural member used as a pillar in the method of the present invent will now be explained. FIG. 4(*a*) is a perspective exploded view showing the plywood laminated material and FIG. 4(*b*) is a perspective view of the same. FIG. 5 is a diagram showing comparison in the strength between the plywood laminated material used in the method of the present invention and common lumber material. The structural member used as a pillar in the method of the present invention incorporates the plywood laminated material 9 made of a plurality of sheet plywood boards 8 (FIGS. 4(*a*) and 4(*b*)). More specifically, the plywood laminated material 9 comprises four of the plywood boards 8 of 5-ply type and 18 mm thick. The material of the plywood board 8 is broad-leaf trees which is as high as desirable in toughness and strength. It is found that when the plywood laminated material 9 has been fabricated satisfying the above requirements, its strength to compression and bending is about 2.5 times higher than traditional plywood materials (using needle-leaf trees) and its shear strength is substantially 2 times higher (FIG. 5). The plywood laminated material 9 itself has a higher strength suited for use as a pillar.

Figure 6:
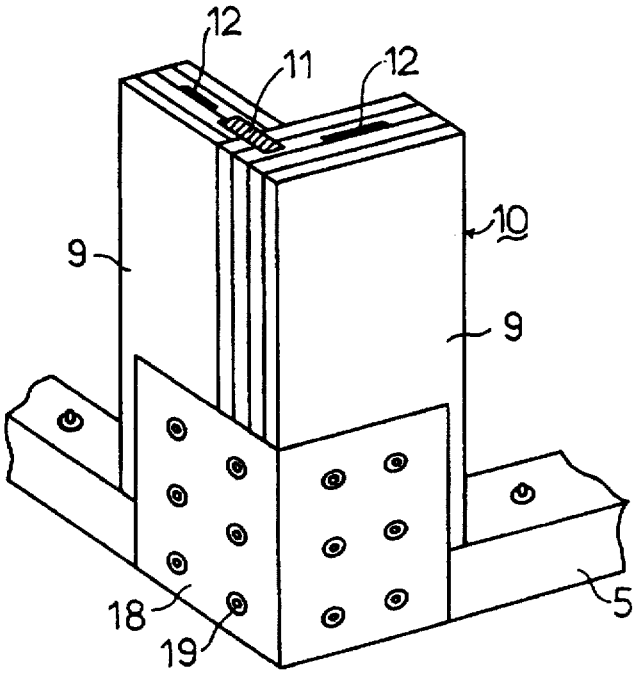
FIG. 6 is a perspective view showing a form of the pillar installed on the sills at a corner of the building.

One form of the pillar or structural member applied to a corner of the building will be explained. FIG. 6 is a perspective view showing the pillar 10 being mounted on the sills 5 at a corner of the building. The pillar 10 is a structural assembly made of the two plywood laminated materials 9 bonded to each other with their laminating directions being perpendicular to each other, having an L shape in cross section. The pillar 10 of the two plywood laminated materials 9 bonded to each other in the L shape is higher in the strength to compression, bending and shear than the single plywood laminated material 9 of a pillar form. The pillar 10 is also increased in the contact area to the sills 5 thus giving a higher joining strength with the sills 5 and causing the building to have a higher rate of earth-quake resistance. In addition, a joint supplement 11 of narrow strip shape is embedded at a right angle to and in a substantially center region of the interface between the two plywood laminated materials 9 of the pillar 10. The joint supplement 11 is tightly joined to both the plywood laminated materials 9 so that the bonding strength at the interface is increased against separation. Particularly, the resistance against a stress exerted from the directions parallel to the interface will be enhanced. Also, it is a good idea that the plywood laminated material 9 has a lengthwisely extending slit provided therein where a reinforcement strip 12 of a steel material is accommodated to increase further the compression, bending, and shear strength of the pillar 10.

Figure 7:
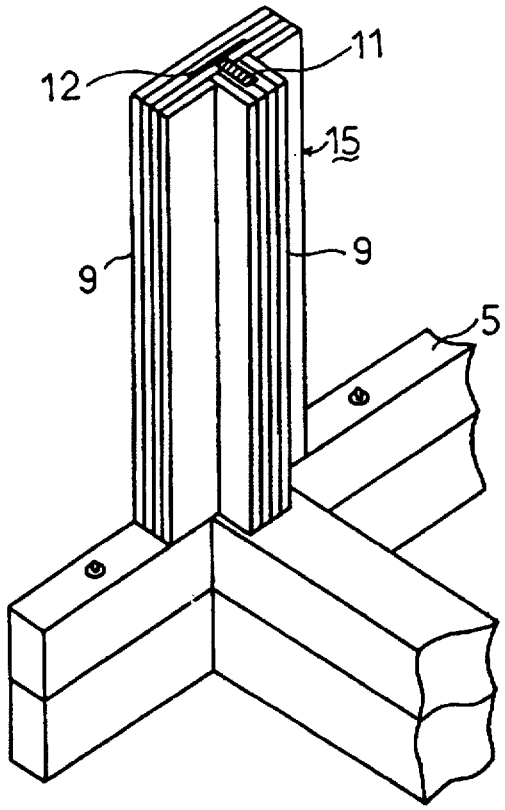
FIG. 7 is a perspective view showing another form of the pillar installed on the sills.

Another form of the pillar applied to a T joint location where two walls of the building are connected at a right angle to each other. FIG. 7 is a perspective view showing the pillar 15 mounted on the sills 5 for the application. The pillar 15 comprises two of the plywood laminated materials 9 bonded securely to each other. The bonding is made by fitting one side edge of one of the plywood laminated materials 9 into a recess provided in one surface of the other, thus forming a T shape in cross section. The pillar 15 like the pillar 10 is thus increased in the compression, bending, and shear strength, as compared with a pillar form of the single plywood laminated material 9, causing the building to have a higher earth-quake resistance. It is possible to increase the bonding strength against separation between the two plywood laminated materials 9 by embedding a joint supplement 11 in the interface between the same in an equal manner to as described for the pillar 10. Similarly, a reinforcement strip 12 of a steel material may be fitted into a lengthwisely extending slit provided in the pillar 15 to increase the physical strength.

Figure 8:
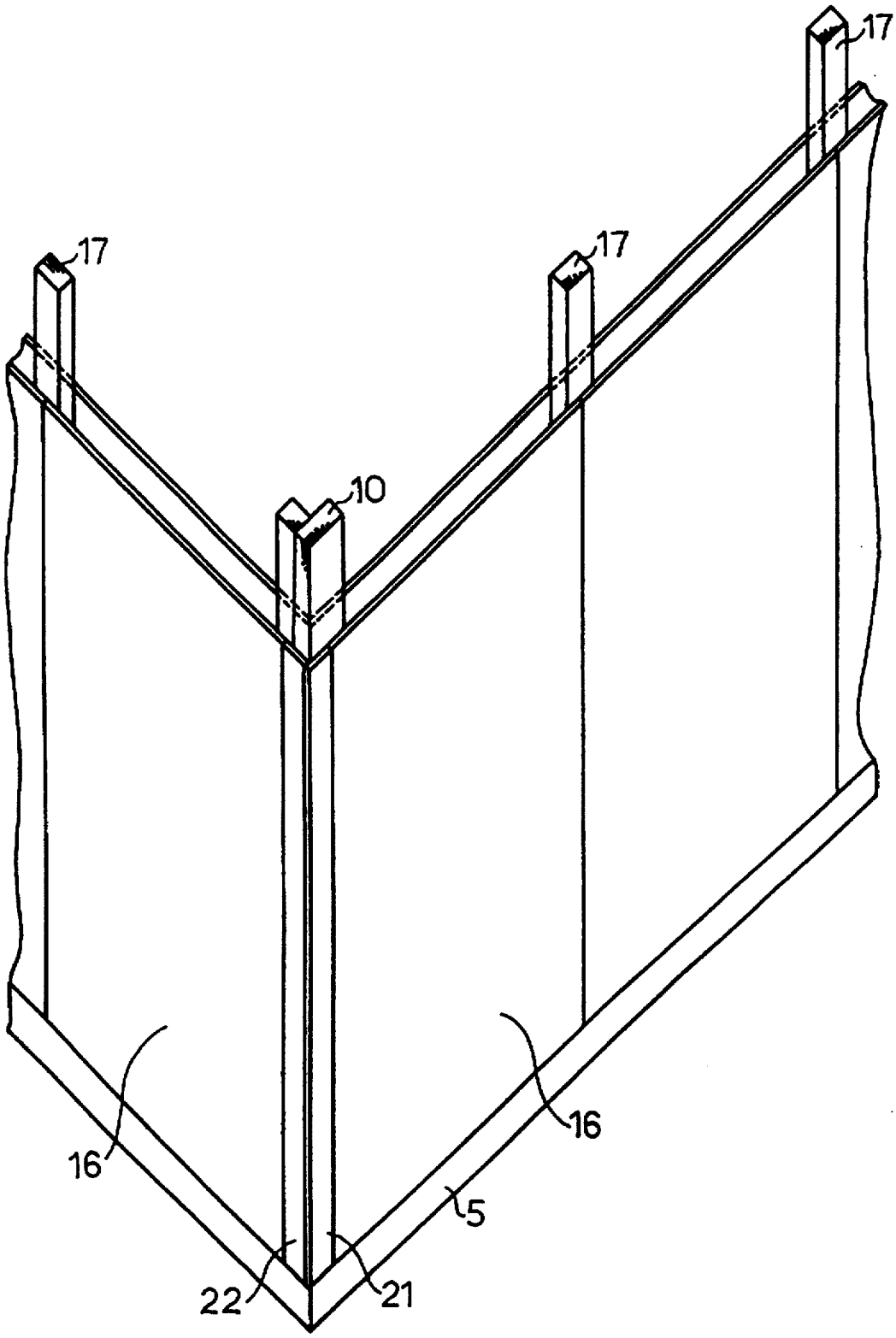
FIG. 8 is a perspective view showing a wall structure of the first floor of the building.
Figure 9:
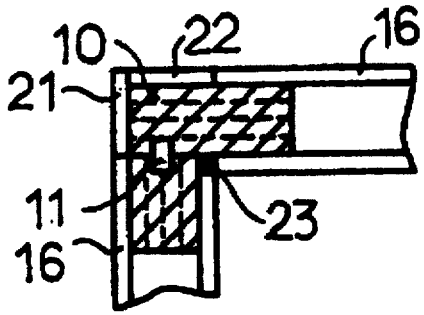
FIGS. 9(*a*) and 9(*b*) are plan views showing the pillars of an L and T shape in cross section respectively.
Figure 9:
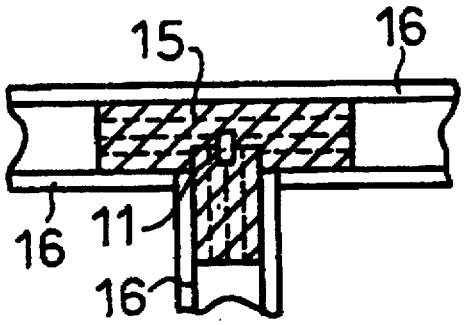
Figure 10:
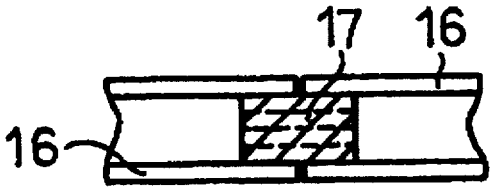
FIG. 10 is a plan view of a joint between two wall panels.
Figure 11:
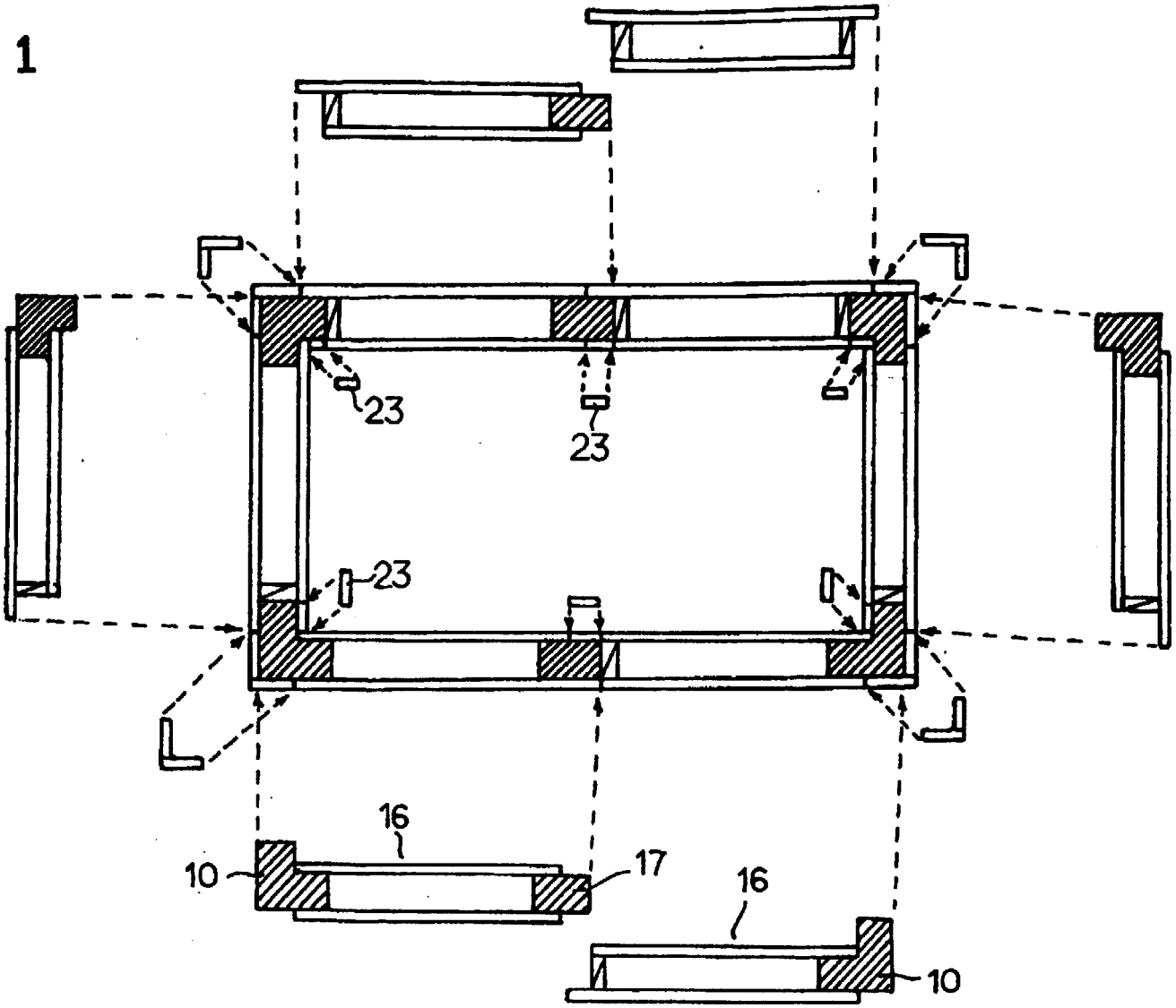
FIG. 11 is an explanatory view showing assembly of the wall structure.

The installation of wall structure will be described. FIG. 8 is a perspective view showing a wall structure in a first story of the building. FIGS. 9(*a*) and 9(*b*) are plan views showing the two different pillars 10 and 15 respectively installed with wall panels. FIG. 10 is a plan view showing a joint between two wall panels. FIG. 11 is an explanatory view showing installation of the wall structure. The wall structure of the building is substantially composed of the pillars, e.g. 10, and the wall panels 16. The wall panel 16 is identical in the construction to the floor panel 3, in which the two surface boards 3*a* is separated from each other by a distance equal to the thickness of the pillar 10. The wall panels 16 are joined to each other by any of the pillar 10, pillar 15, and a pillar 17 made of the single plywood laminated material 9 fitted into one end of each wall panel. More specifically, the installation of the wall structure starts with a first wall panel 16 accompanied with the two pillars 10 and 17 at both sides is mounted on the sill 6 and another wall panel 16 provided at one side with the pillar 17 is joined to the first wall panel 16. Repeating this action completes the installation. The pillar 10 in the wall panel 16 is mounted to the sill 5 by means of steel plates 18 placed and fastened to both, inner and outer, surfaces of the pillar 10 with through bolts 19.

The wall panels 16 are joined one another by fitting a wall panel 16 having no pillar onto the pillar, e.g. 17, mounted in the installed panel 16 and tightening it with nails or the like. The mounting of the wall panel 16 to the corner pillar 10 as well as the joining the wall panels 16 having the pillar 17 to each other is assisted by mounting a pair of lengthy plywood strips 21 and 22 trimmed to sizes to the outer sides of the corner pillar 10 respectively, and filling a gap between the two wall panels 16 with a filler strip 23 made by cutting a plywood board into a size of the gap (FIG. 11). Accordingly, the two wall panels 16 are neatly joined to each other by the corner pillar 10 without leaving the gap.

Figure 12:
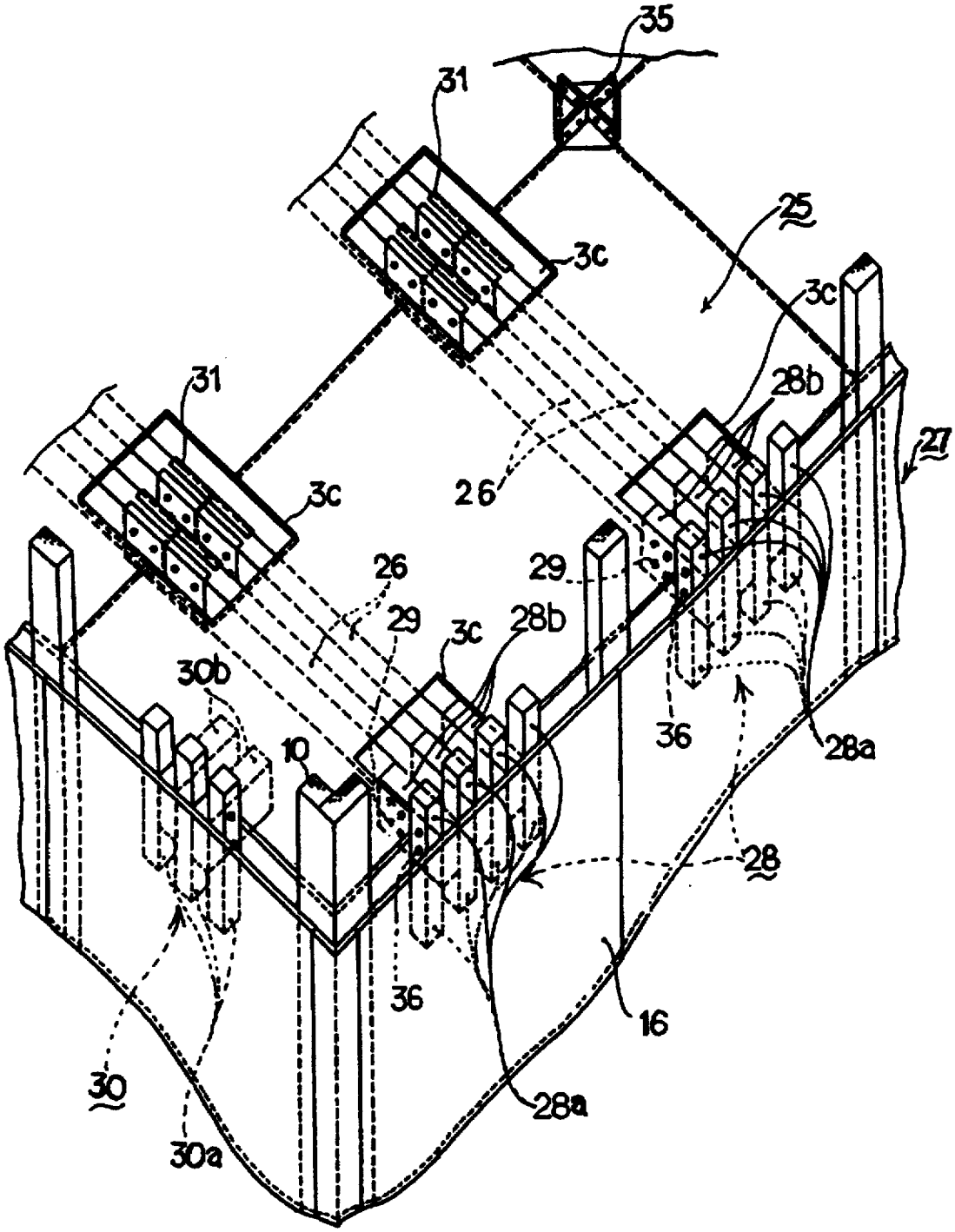
FIG. 12 is a perspective view showing a second-floor structure.
Figure 13:
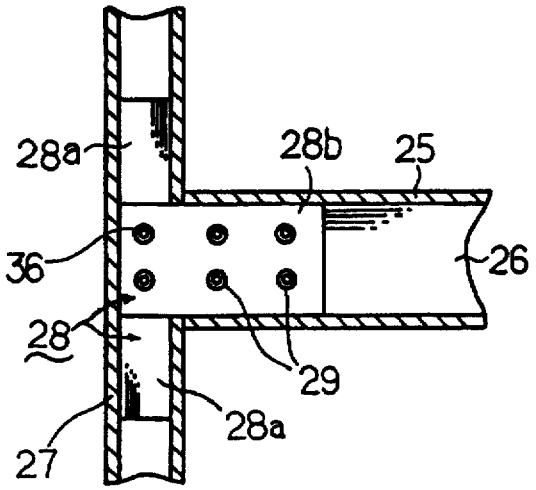
FIG. 13 is a traverse cross sectional view showing a joint between the floor panel and a panel support.
Figure 14:
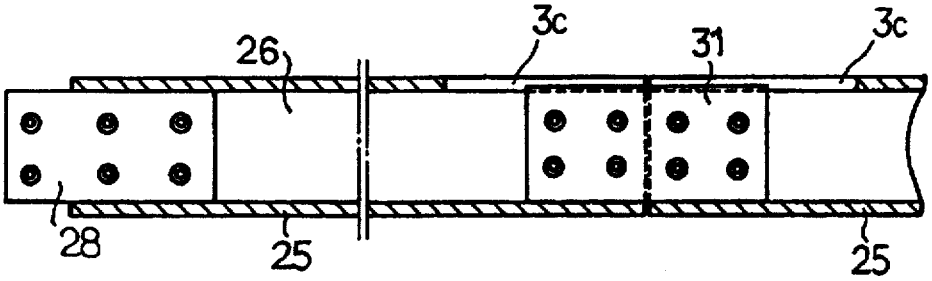
FIG. 14 is a traverse cross sectional view showing a joint of beams in their respective floor panels.

The installation of second-floor structure will now be explained. FIG. 12 is a perspective view showing an arrangement of a second-floor structure. FIG. 13 is traverse cross sectional view showing the joint between a floor panel and a panel support. FIG. 14 is a traverse cross sectional view showing the joint between beams in their respective floor panels. The second-floor structure comprises second-floor panels 25 identical to the prescribed floor panel 3. The second-floor panel 25 includes beams 26 mounted in a construction of the floor panel 3 and has openings 3*c* provided in its upper surface board 3. The second-floor panel 25 is joined to a wall structure 27 of the first floor with its beams 26 fastening by bolts 29 to a panel support assembly 28 mounted in the first-floor wall structure 27. The second-floor panel 25 is also supported by a panel support assembly 30 of which part extends from one side of the first-floor wall structure 27 where the panel support assembly 28 is not installed. The second-floor panels 25 are joined to each other by its beams 26 connecting to each other with beam connectors 31 of a steel material. In addition, a panel reinforcement metal joiner 35 is mounted at each corner of the second-floor panel 25 for tightening the joining of the second-floor panels 25.

The panel support assembly 28 will be explained in more details. The panel support assembly 28 comprises arms 28*a* mounted in the first-floor wall structure 27, and arms 28*b* for joining to the corresponding beams 26 of the second-floor panel 25. The arms 28*a* are four of the plywood laminated materials 9 and the arms 28*b* are three of the plywood laminated materials 9. The arm 28*b* are crosswisely arranged alternate with and at a right angle to the arms 28*a* so that they extend to substantially center regions of the arms 28*a*. The arms 28*a* and 28*b* are tightened one another by through bolts 36 extending crosswisely. The panel support assembly 28 is installed by fitting its arms 28*a* into the first-floor wall structure 27 which has been installed previously. The joining between the second-floor panel 25 and the first-floor wall structure 27 is conducted by fitting the arms 28*b* into the second-floor panel 25 to join with the corresponding beams 26 (FIG. 12) and tightening the arms 28*b* and the beams 26 with the through bolts 29. The mounting and tightening the bolts 29 is carried out through the openings 3*c* in the second-floor panel 25.

The panel support assembly 30 on the first-floor wall structure 27 is joined to one side of the second-floor panel 25 where the panel support assembly 28 is not joinable to the beams 26. More specifically, the panel support assembly 30 comprises three arms 30*a* for fitting into the first-floor wall structure 27 and two arms 30*b* for extending into and supporting the second-floor panel 25. While the second-floor panel 25 being supported on the panel support assembly 30, it is joined to the first-floor wall structure 27 by the arms 30*b* tightening with nails or the like. It is preferable for ease of installation of the panel support assemblies 28 and 30 to maintain the outer surface board 3*a* of each wall panel 16 higher than the inner surface boards 3*a* of the same.

Figure 15:
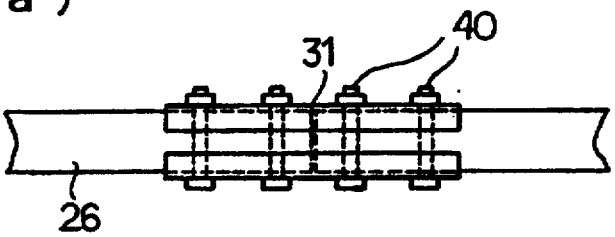
FIGS. 15(*a*) and 15(*b*) are a plan view of a joint between the beams with beam connectors and a side view of the beam connector.
Figure 15:
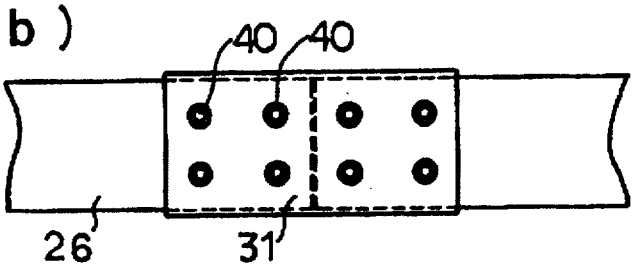
Figure 16B:
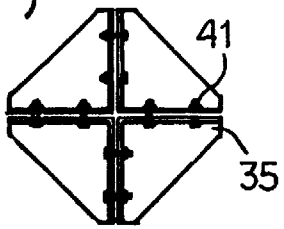
FIGS. 16(*a*), 16(*b*), 16(*c*), and 16(*b*) are a perspective view, a plan view, a back view, and a side view of a panel reinforcement metal connector respectively.
Figure 16C:
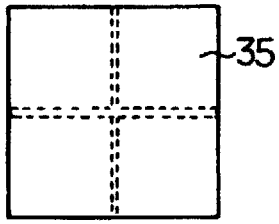
Figure 16D:
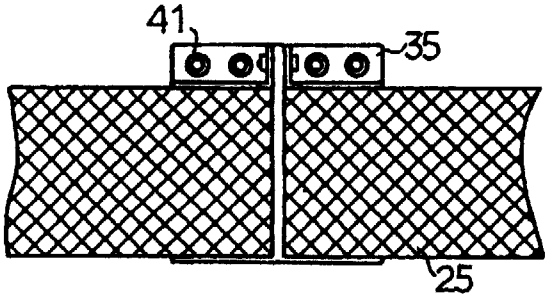
Figure 16A:
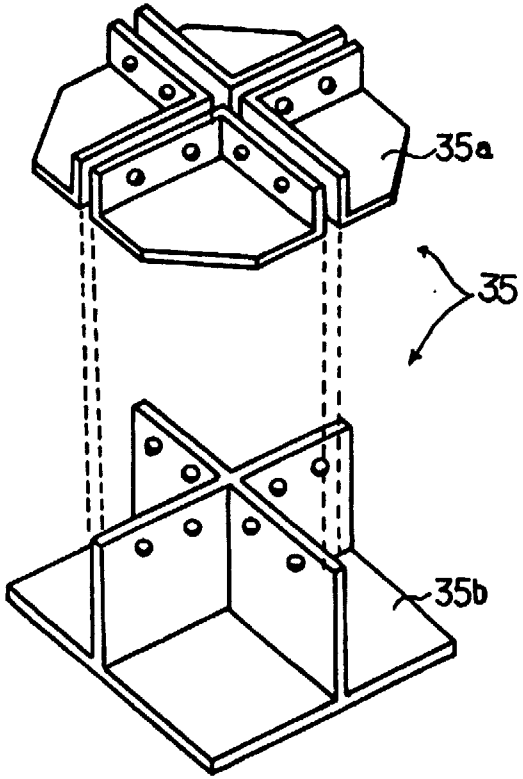

The jointing of the second-floor panels 25 to each other will be explained. FIG. 15(*a*) is a plan view showing a joint between the beams 26 with beam connectors 31, and FIG. 15(*b*) is a side view of the same showing the beam connector 31 more clearly. FIGS. 16(*a*), 16(*b*), 16(*c*), and 16(*d*) are a perspective view, a plan view, a back view, and a side view of the panel reinforcement metal connector 35 respectively. The second-floor panels 25 are joined to each other by connecting their corresponding beams 26 to each other with the beam connectors 31 and their corresponding four corners to each other with the beam reinforcement metal connector 35. The beam connector 31 can easily be accessed and fastened by through bolts 40 to the beams 26 through the openings 3c provided in the upper surface board 3a of each second-floor panel 25. As the plural beams 26 are joined together, their joining strength is substantially equal to that of a single solid beam. The panel reinforcement metal connector 35 to be mounted to four corners of the second-floor panels 25 is shaped so that it holds securely the four second-floor panels 25 at their corners. More particularly, the panel reinforcement metal connector 35 comprises an upper section 35a and a lower section 35b which are joined to each other by a plurality of bolts 41 which can be fastened at the upper section 35a. As the bolts 41 is fastened, the four second-floor panels 25 are joined to each other at their respective corners. After the installation, each opening 3c is closed with a sized plywood plate.

As described, the floor structure comprises a number of the second-floor panels 25 joined to each other with the beam connectors 31 and the panel reinforcement metal connectors 35 and also, connected by the panel support assemblies 28 and 30 to the wall structure 27. This allows non of the traditional flooring structural components such as joists and braces to be involved and will thus be reduced in the number of construction steps, contributing to the speed-up of the working period. Also, the beams 26 are securely joined to each other with the beam connectors 31 to support the second-floor panels 25 and also anchored by the bolts to panel support assemblies 28. Hence, the floor structure will be higher in the physical strength than other conventional floor frameworks employing a large number of joists and braces.

Figure 17:
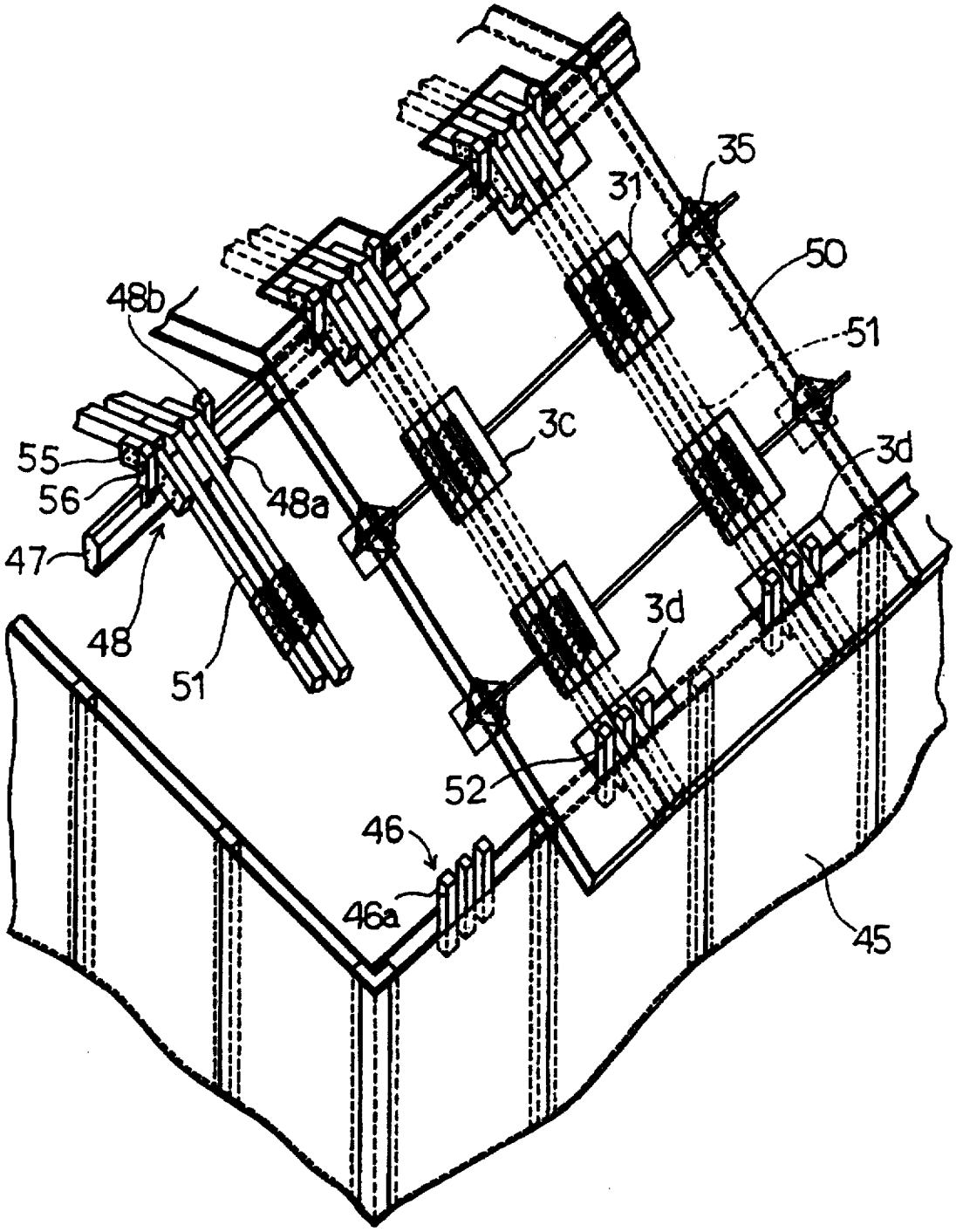
FIG. 17 is a perspective view showing a roof structure with a joint between arms and retainers seen at near side.

The installation of roof structure will now be described. FIG. 17 is a perspective view of an arrangement of a roof structure of the building, in which a near side indicates a joint between arms and joiners. A second-floor wall structure 45 which is identical in the construction to the first-floor wall structure 27 is at its top provided with joiner assemblies 46, each composed of three of the plywood laminated materials 9 of which lowermosts are fitted and fastened by nails or the like into the second-floor structure 45. A ridge beam 47 is arranged extending along the center of the roof structure. Also, retainer assemblies 48 made of the plywood laminated materials 9 are mounted on the ridge beam 47. The retainer assembly 48 comprises three beam retainers 48a formed of an inverted V shape corresponding to the angle of the roof, and two support blocks 48b for fixedly joining the beam retainers 48a to the ridge beam 47. The roof structure is built by connecting roof panels 50, which are identical in the construction to the second-floor panel 25 but include roof arms 51 (beams 26), to the second-floor wall structure 45 with the joiner assemblies 46, and joining them to each other at the ridge with the retainer assemblies 48. More specifically, the roof panels 50 are joined to each other with the panel reinforcement metal connectors 35 while their roof arms 51 are joined to each other by the beam connectors 31.

The joiner assembly 46 will now be explained in more details. The joiner assembly 46 comprises three joiners 46a arranged at equal intervals of a distance equal to the width of the roof arm 51 so that the roof arms 51 are fitted and secured between the joiners 46a. The roof panel 50 has openings 3d provided in the upper surface board 3c thereof across which the roof arms 51 extend. The opening 3d gives an access to the roof arms 51 which are thus joined to the joiner assemblies 46 with through bolts 52. When the roof arms 51 have been joined to the joiner assemblies 46, each joint between the roof arm 51 and the inside of the wall structure 45 is reinforced with steel plates (not shown) or the like. Extensions of the joiners 46a projecting upward from the roof panels 50 are cut to be flush with the upper surfaces of the roof panels 50. The openings 3d are also closed with corresponding sizes of the plywood board. Preferably, the inner surface board 3a of each wall panel 27 of the wall structure 45 is trimmed higher than the outer surface board 3a of the same to match directly a tilting angle of the roof panel 50 and thus provide a proper structural strength.

The retainer assembly 48 will be explained in more details. Its beam retainers 48a are arranged at equal intervals of a distance which is equal to the width of the roof arm 51 so that the roof arms 51 are fitted and secured between the beam retainers 48a. The joining of the roof arms 51 to the beam retainers 48a is executed separately at each side of the ridge beam 47 of the roof. The roof arms 51 are fixedly joined to the beam retainers 48a with through bolts 55. The two support blocks 48b are located to sandwich the beam retainers 48a joined alternate with the roof arms 51 and joined to each other by bolts 56 extending through the beam retainers 48a and support blocks 48. The ridge beam 47 has holes provided therein for accepting the lower ends of the support blocks 48b which are thus fit joined to the ridge beam 47. The fit joining between the support blocks 48b and the ridge beam 47 allows the roof panels 50 to be joined by the retainer assemblies 48 to the ridge beam 47. The roof panels 50 are joined to each other by the same manner as of the second-floor panels 25 with their roof arms 51 (beams 26) fastening to each other and the panel reinforcement metal connectors 35 connecting at each corner thereof.

As described, the roof structure is composed of the roof panels 50 joined to the wall structure 45 and the ridge beam 47 with the joiner assemblies 46 and the retainer assemblies 48 as well as the panel reinforcement metal connectors 35 for connection at each corner of the roof panels 50, while their roof arms 51 connecting to each other securely. This allows non of the traditional roofing structural components such as rafters, struts, and purlins to be involved, thus reducing the number of construction steps. As understood, the roof structure of the present invention will be much easy in fabrication. As the roof structure comprises the roof panels 50, each consisting mainly of two plywood boards having a plurality of cross members arranged therebetween and reinforced with a group of the roof arms 51, it will be higher in the physical strength than any conventional roof framework.

The structural members used in the method of the present invention are prefabricated at factory and transported to a site of construction, thus eliminating extra processes at the construction site. Hence, assembly of the structural members such as the floor panels 3, the wall panels 16, and the roof panels 50 on the sills 5 simply leads to erection of a building. The structural members, floor structure, and roof structure for a wooden building, and the method of building with the same according to the present invention are not limited to the embodiments, but modifications and changes may be carried out with equal success.

What is claimed is:

1. A structural member for a wooden building comprising:

a pair of elongated members formed of a plywood laminated material including a plurality of plywood boards laminated to each other, each of said elongated members having face surfaces and elongated edge surfaces;

said elongated members being joined to each other by abutting and bonding one of said elongated edge surfaces of one of said pair of elongated members to one of said face surfaces of the other of said pair of elongated members so that laminating directions of the pair of elongated members are perpendicular to each other; and a strip member embedded at a right angle to and in a substantially center region of an interface between the two plywood laminated materials extending into said one of said elongated edge surfaces and into said one of said face surfaces to supplement said bond between the pair of elongated members.

2. A structural member for a wooden building comprising:

a pair of elongated members formed of a plywood laminated material including a plurality of plywood boards laminated to each other, each of said elongated members having face surfaces and elongated edge surfaces; and said elongated members being joined to each other by bond fitting one of said elongated edge surfaces of one of said elongated members into a recess provided in one of said face surfaces of another one of said elongated members so that laminating directions of the two plywood laminated materials are perpendicular to each other; and said recess having bottom and opposing side surfaces defined by a portion of said plurality of plywood boards.

3. A structural member for a wooden building comprising:

a pair of elongated members formed of a plywood laminated material including a plurality of plywood boards laminated to each other, each of said elongated members having face surfaces and elongated edge surfaces;

said elongated members being joined to each other by bond fitting one of said elongated edge surfaces of one of said elongated members into a recess provided in one of said face surfaces of another one of said elongated members so that laminating directions of the two plywood laminated materials are perpendicular to each other; and a strip member embedded at a right angle to and in a substantially center region of an interfacebetween the pair of elongated members and extending into said one of said elongated edge surfaces and into a bottom surface of said recess to supplement said bond between the pair of elongated members.

4. A structural member according to any one of claims 1 to 3, further comprising the elongated members having a lengthwisely extending hole provided within a center region and an elongated steel strip fitted into the hole such that all elongated sides of said steel strip are in contact with said plywood laminate material.

5. A floor and wall structure for a wooden building comprising:

first and second panel support assemblies each including:

a first group of beam members formed of plywood laminated materials including a plurality of sheet plywood boards bonded one over the other;

a second group of beam members formed of said plywood laminated materials;

said first group of beam members being oriented horizontally and alternately interposed between and at right angles to center regions of said beam members of said second group, said first and second group of beam member being joined with through bolts to form a sideways oriented T-shaped structure;

first and second walls each having a spaced apart double plywood board structure and which are interposed between pillars of the building;

a floor panel including: an upper surface board;

a lower surface board; and a set of beams space apart and sandwiched between the upper and lower surface boards and having a length equal to a width of the two surface boards, said set of beams being space apart a distance corresponding to a width of said first group of beam members and having a width corresponding to a spaced apart distance of said first group of beam members to permit a fitted engagement of said set of beams and said first group of beam members;

said first panel support assembly having said first group of beam members extending between said set of beams and fixed thereto with through bolts and said second group of beam members extending vertically downward into a space defined by said space apart double board structure of said first wall and fixed thereto;

said second panel support assembly having said first group of beam members horizontally extending in a fitted engagement between said upper and lower surface boards of said floor panel at a portion thereof absent said set of beams and fastened thereto, and said second group of beam members extending vertically downward into a space defined by said space apart double board structure of said second wall and fixed thereto; and said floor panel being connectable to another floor panel by joining ends of said set of beams opposite said first panel support assembly to corresponding beams of another floor panel with metallic beam connectors.

6. A roof structure for a wooden building comprising:

a ridge beam having retainer assemblies mounted thereon, the retainer assemblies including:

v-shaped beam members formed of plywood laminated materials including a plurality of sheet plywood boards bonded one over the other; and said ridge beam having sets of said v-shaped beam members fix thereto in an inverted v orientation, said v-shaped beam members of said sets being spaced apart a first predefined distance and said sets being spaced apart a second predefined distance;

a roof panel including upper and lower surface boards and a set of beams spaced apart and sandwiched between the upper and lower surface boards, said beams being spaced apart a distance corresponding to a width of said v-shaped beam members and having a width corresponding to said first predefined distance to fittingly engage said sets of v-shaped beam members, and having a length equal to a width of the upper and lower surface boards;

a wall having a double plywood board structure and interposed between two pillars of the building, and a joiner assembly including vertical beam members extending upwards from said wall and disposed to fittingly engage said set of beams of said roof panel in an interleaved engagement for joining the roof panel to the wall;

said set of beams being joined to said v-shaped beams members of the retainer assembly and said vertical beam members of said joiner assembly with through bolts so that the roof panel is installed on the ridge beam and the wall; and said roof panel being connectable to another roof panel by joining said set of beams to corresponding beams of the other roof panel with metallic beam connectors.

7. A method of constructing a wooden building comprising the steps of:

(a) mounting panels, each panel having two, upper and lower, surface boards sandwiching a plurality of cross members, on a foundation provided with panel supports for supporting the panels;

(b) producing a wall structure of the first floor by joining the panels, including wall panels, each panel provided at one side with the pillar made of the plywood laminated material defined in any of claims 1 to 3, to each other on sills of the foundation; and (c) producing a roof structure by:

mounting retainer assemblies, each assembly on a ridge beam at the center of a roof wherein each retainer assembly includes:

v-shaped beam members formed of plywood laminated materials including a plurality of sheet plywood boards bonded one over the other; and said ridge beam having sets of said v-shaped beam members fix thereto in an inverted v orientation, said v-shaped beam members of said sets being spaced apart a first predefined distance and said sets being spaced apart a second predefined distance;

providing roof panels, each roof panel including upper and lower surface boards and a set of beams spaced apart and sandwiched between the upper and lower surface boards, said beams being spaced apart a distance corresponding to a width of said v-shaped beam members and having a width corresponding to said first predefined distance to fittingly engage said sets of v-shaped beam members, and having a length equal to a width of the upper and lower surface boards;

mounting joiner assemblies to said wall structure, each assembly vertical beam members extending upwards from said wall and disposed to fittingly engage said set of beams of said roof panel in an interleaved engagement for joining the roof panel to the wall;

joining the beams of respective ones the roof panels to the retainer and joiner assemblies with through bolts to connect the roof panels to the ridge beam and the wall structure; and joining the roof panels to each other by tightening said beams to each other with metallic beam connectors.

8. A method of constructing a wooden building comprising the steps of:

(a) mounting panels, each panel having two, upper and lower, surface boards sandwiching a plurality of cross members, on a foundation provided with panel supports for supporting the panels;

(b) producing a wall structure of the first floor by joining the panels, including wall panels, each panel provided at one side with the pillar made of the plywood laminated material defined in any one of claims 1 to 3, to each other on sills of the foundation;

(c) mounting on the wall structure panel support assemblies, each assembly comprising a group of plywood laminated materials, each material made of a plurality of sheet plywood boards bonded one over the other, which are horizontally arranged at a right angle to and alternate with another group of vertically extending plywood laminated materials so that they extend to substantially center regions of the vertically extending plywood laminated materials, all the plywood laminated materials being joined one another with through bolts;

(d) producing a second-floor structure by mounting to the panel support assemblies second-floor panels, each second-roof panel comprising two surface boards and a set of beams sandwiched between the two surface boards and having a length equal to a width of the two surface boards, joining the beams to the panel support assemblies with through bolts, mounting other panel support assemblies on a side of the wall structure where the former panel support assemblies and their corresponding beams are not located other panel support assemblies and fitting their horizontally extending plywood laminated materials into the second-floor panels to support the second-floor panels, and joining the second-floor panels to each other by tightening their beams to each other with beam connectors of a steel material or the like;

(e) producing a wall structure of the second floor by joining the panels, including wall panels, each panel provided at one side with the pillar made of the plywood laminated material defined in any one of claims 1 to 3, to each other; and (f) producing a roof structure by:

mounting retainer assemblies, each assembly comprising a group of plywood laminated materials, each material made of a plurality of sheet plywood boards bonded one over the other, on a ridge beam at the center of a roof for retaining roof panels;

mounting joiner assemblies, each assembly comprising a group of the plywood laminated materials, on the wall structure of the second floor for joining the roof panels to the second-floor wall structure;

joining the beams to the retainer and joiner assemblies with through bolts to connect the roof panels to the ridge beam and the second-floor wall structure; and joining the roof panels to each other by tightening their beams to each other with beam connectors of a steel material or the like.

* * * * *